US005322224A

United States Patent [19]

Ruiz

[11] Patent Number: 5,322,224

[45] Date of Patent: Jun. 21, 1994

[54] UNIFORM GAS FLOW LINEAR BURNER

[76] Inventor: Edward F. Ruiz, P.O. Box 565, San Dimas, Calif. 91761

[21] Appl. No.: 88,131

[22] Filed: Jul. 7, 1993

[51] Int. Cl.[5] ..... B05B 1/14

[52] U.S. Cl. ..... 239/552; 239/557; 239/566

[58] Field of Search ..... 239/552, 566, 557, 554

[56] References Cited

U.S. PATENT DOCUMENTS 2,210,069 8/1940 Ensign ..... 239/557
3,656,879 4/1972 De Vries ..... 239/554

*Primary Examiner*—Carroll B. Dority
*Attorney, Agent, or Firm*—Christie, Parker & Hale

[57] ABSTRACT

A linear burner has a tubular casing with an elongated opening having inwardly sloping sides. A threaded stainless steel rod is disposed across the opening such that the threads contact the opening sides to support the rod. A series of gas flow passages are formed between the opening sides and the rod threads.

22 Claims, 1 Drawing Sheet

UNIFORM GAS FLOW LINEAR BURNER

FIELD OF THE INVENTION

The invention pertains to a gas burner which acts as a constant flow corrosion free valve.

BACKGROUND OF THE INVENTION

Linear burners and, in particularly, tubular ribbon burners are commonly used in the area of commercial baking. A typical tubular burner comprises a steel tube with a sealed end and a threaded end for connection to a gas supply, such as an force air or air inspirator for mixing a combustible gas with air.

The burner has a plurality of gas passages or ports disposed along its length.

In earlier burners, the passages or ports were formed by a series of drilling holes along the length of the burner tube.

Many modern burners are of the ribbon type, wherein a plurality of corrugated sheet metal strips are inserted into an elongate opening cut into the burner tube. Ribbon burners are disclosed for instance in U.S. Pat. No. 1,758,628 to Thurm et al., U.S. Pat. No. 2,210,069 to William B. Ensign and U.S. Pat. No. 2,443,101 to John Harold Flynn et al., each of which are incorporated herein by reference.

In a typical ribbon burner, the elongate opening has flat parallel sides and the strips are stacked so as to form an insert which just fits through the opening. To support the insert and keep the various strips aligned, a plurality of pins are inserted at intervals along the length of the tube and transversely through the tube and the plurality of strips. Typically, the pin ends are welded to the tube or casing. FIG. 6 of '628 patent shows the use of a wire wound rod as an insert between plates to provide the burner ports. The wire wound rod is retained in the assembly by transverse pins.

Prior art ribbon burners suffer from a number of disadvantages. The burners are relatively complex and expensive to manufacture and are subject to corrosion and fouling with use. Once the burner tube has been cut to size, threaded at one end and sealed at the other, and the opening has been cut, significant work remains to be done. The ribbon strips must be formed and cut to length and width and holes or slots must be drilled or cut through the strips for subsequent receiving of the transverse pins. Corresponding transverse holes must be drilled through the burner tube.

In a typical ribbon burner, to economize on materials and to maintain adequate gas flow, the insert only slightly penetrates into the central cavity of the burner tube, the holes in the burner tube which receive the pins must be drilled oblique to the tube surface. Such drilling is often difficult and imprecise.

The insert is then assembled from the strips and carefully held in the opening for insertion of the pins. As the opening has parallel sides, the insert may have a tendency to slip, thus requiring care to hold the insert in the proper orientation. The pins having been cut to length are then inserted through the casing and the insert and welded to the casing.

In operation, the thin strips will have a propensity to corrode due to condensation of water of the air used in combustion and the products of combustion and will also tend to become fouled with carbon and other deposits. Forming the ribbons out of a corrosion resistant stainless steel aids but greatly add to the expense. In consequence of using less resistant materials of construction at various intervals the burners must be either replaced or disassembled for replacement of the insert. The latter situation will entail a cumbersome extraction of the pins and a possible forced extraction of the insert, which may have become corroded to or otherwise stuck in the burner opening. The replacement insert will be formed and installed in a similar tedious manner as in the original fabrication.

It is therefore desirable that a burner be designed for ease and low cost of manufacturing, with resistance to fouling and corrosion and more uniform fuel burn characteristics.

SUMMARY OF THE INVENTION

According to the present invention, there is provided a burner having a tubular casing provided with an elongate opening preferably with inwardly sloping sides, at least one corrosion resistant threaded rod disposed along the opening with the threads contacting at least one opening side. The spacings formed by the threads and tube sides, an adjacent rod or spacer provide a plurality of gas flow passages to enable uniform combustion of fuel and air. The threaded rod is preferably formed of stainless steel for low cost corrosion resistance and can be secured by spot welding to the casing.

As indicated multiple rods may be disposed across a single opening so as to multiply the number of gas passages. The rods may be separated by a baffle to further increase the effective number of gas passages.

DESCRIPTION OF THE DRAWINGS

The above-mentioned and other features of this invention are more fully set forth in the following detailed description of the presently preferred and other embodiments of this invention; such description is presented with reference to the accompanying drawings wherein.

DESCRIPTION OF THE ILLUSTRATED EMBODIMENTS

Figures 1A, 1B, 1C, 2A, 2B, 2C:
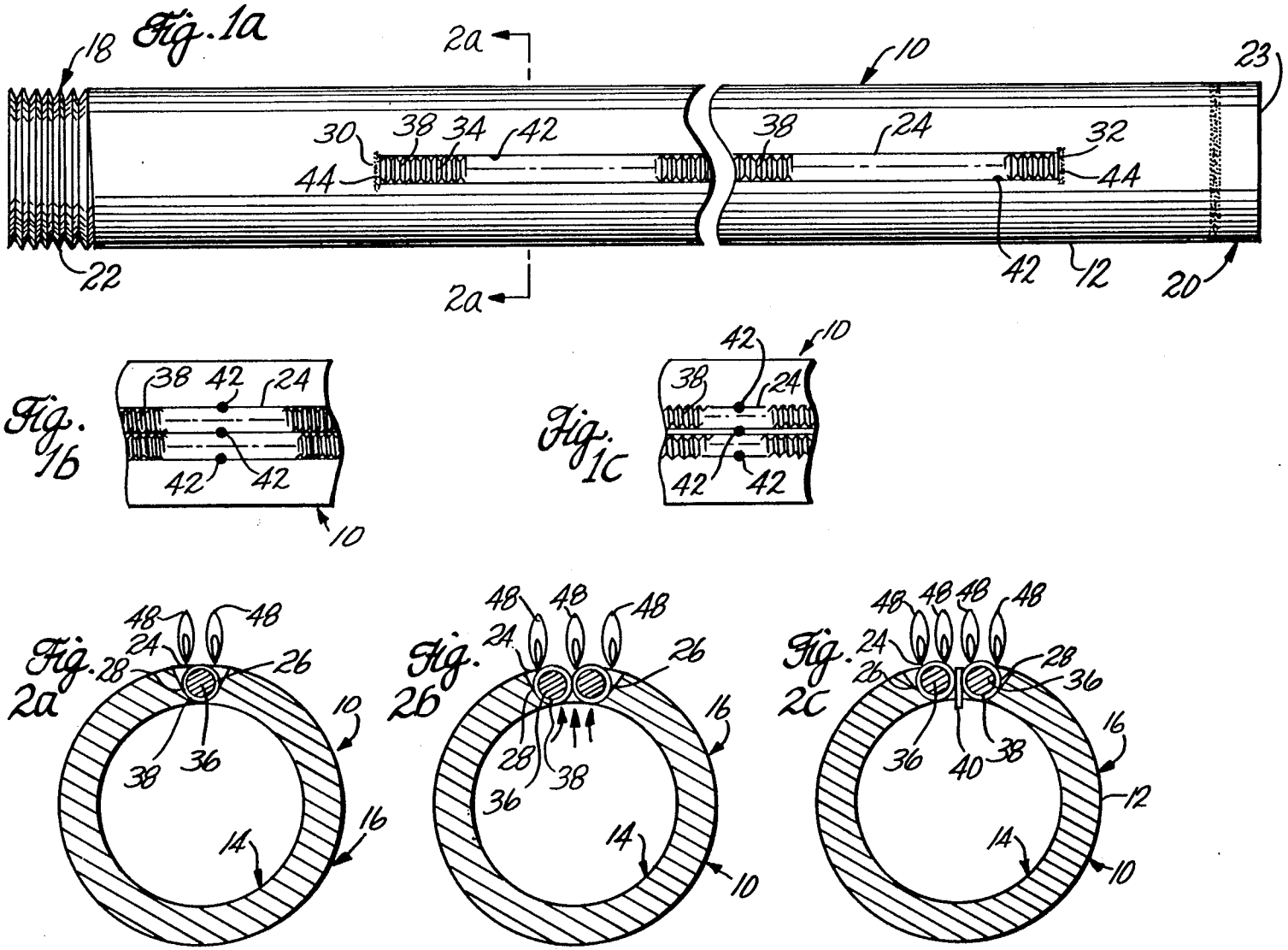
FIG. 1*a* is a top elevational view of a burner constructed according to principles of the present invention having a single threaded rod.
FIG. 1*b* is a partial top elevational view of a burner having two threaded rods.
FIG. 1*c* is a partial top elevational view of a burner having two threaded rods separated by a baffle.
FIG. 2*a* is a cross-sectional view of the burner of FIG. 1*a* showing the flames provided by its ports.
FIG. 2*b* is a cross-sectional view of the burner of FIG. 1*b* again showing the flames provided by its ports.
FIG. 2*c* is a cross-sectional view of the burner of FIG. 1*c* also showing the flames provided by its ports.

With reference to the drawings, a uniform gas flow linear burner of this invention 10 is formed from a conduit 12, preferably of circular cross section having an inner surface 14, an outer surface 16 and ends 18 and 20. Threads 22 are formed or provided at one end 18. A plug 23 may be located in the opposed end 20 of the conduit for sealing the conduit. Alternatively end 20 may be threaded for capping or coupling to one or more burners in series. At least one elongate opening 24 is formed in and along the length of conduit or tube 12. The opening has sides 26 and 28 and ends 30 and 32. A threaded rod 34 having a core 36 and threads 38 is disposed across the opening with the threads contacting the opening sides 26 and/or 28 or spacer 40. A plurality of gas flow passages are created in parallel rows between the threaded rods and the opening sides. A plurality of spot welds 42 secure the rod to the tube at various intervals and/or spaces along the length of the rods. Welds 44 and 46 secure the ends of the rod to the tube at the opening ends and if desired serve to seal any gaps therebetween.

In operation the burner produces a plurality of flames 48 from the gas flow passages formed by an opening between the threads and the side walls of the conduit or spacer 40.

It is presently preferred that conduit 12 be formed from American Standard Schedule 40 one-inch nominal diameter steel pipe stock. The end 18 is threaded with standard 11½ threads per inch pipe threads. Plug 27 is formed of steel and welded in place. The sides 26 and 28 of the opening 24 are preferably sloped inwardly, that is they generally converge from the outer 16 to inner 18 surfaces of the tube. The sides are preferably constructed with a curved profile, to more distinctly define the gas flow passages, as can be seen in FIG. 2*a*. This enables opening 24 to cradle the rods for ease of assembly and minimization of spot welds. The rod preferably used is a 10–24 stainless steel threaded rod. That is, a size 10 rod having 24 threads per inch. Any other size rod or thread may be used so long as the frame 48, is retained just above the surface of the rod and uniform along its length stainless steel rod has the advantages of being a readily available and a relatively inexpensive stock item which also offers a high degree of resistance to corrosion and fouling. It will be understood that the corrosion resistant materials such as bronze can be used. By the term "corrosion resistant" there is meant resistance to corrosion as induced by electrolysis and other events caused by water in air or water generated as a product of combustion.

To fabricate the burner, the tube 12 is first cut to length, the threads, 8 may be cut in one end and a plug, 22 may be welded to the other. The opening 24 is then cut via any of a variety of means of means known in the art. The threaded rod, the size and threading of which are preselected to produce a desired number and size of gas flow passages, is similarly cut to a length slightly smaller than that of the opening and is placed across the opening. The inwardly sloping sides of the opening will prevent the rod from falling through the opening and therefore facilitate easy assembly. Thereafter, the welds 42 and 44 may be made.

An embodiment shown in FIGS. 1*b* and 2*b* has two threaded rods for producing a plurality of gas flow passages arranged in three rows. In addition to rows of gas passages formed between the sides of the opening and threaded rods, gas flow passages are formed between the rods. In addition to the welds between the rods and the tube, a plurality of welds may be used to secure the rods to each other. The burner is otherwise identical to that shown in FIG. 1 and FIG. 2*a*, however, the opening is wider so as to accommodate the two rods. In fabrication, the rods may be initially secured to each other by spot welds and then inserted across the opening as a unit and then secured to the tube by spot welds. This is advantageous as if the rods were inserted individually, there may exist a propensity for the rod to fall through the opening.

As illustrated, the rods are aligned so that they are in phase with each other, i.e, the outermost portions of the threads of each rod are in contact with each other. This yields the largest possible gas flow passages. It can be easily seen that if the phase of the rods is staggered yet contact maintained, the size of the gas flow passages may be reduced to any desired degree limited only by the depth of the threads. In operation, the burner will produce a plurality of flames from gas passages formed by the threads and the tube or between rod with size of the ports being variable based upon the relative phase of the rods.

An embodiment shown in FIGS. 1*c* and 2*c* has two threaded rods 230*a* and 230*b* and a baffle 40 preferably formed of corrosive resistant materials for producing a plurality of gas flow passages arranged in four rows. The baffle is a preferably a stainless steel strip having sides which are in contact with adjacent threaded rods. In addition to gas flow passages formed between the sides of the opening and the threaded rods, gas flow passages are formed between the rods and the baffle. In addition to the welds between the rods and the tube, a plurality of welds are employed and secure the rods respectively to the baffle. The burner is otherwise identical to the previous embodiments, however, the opening is wider so as to accommodate the two rods and baffle. The rods and baffle may be initially secured to each other by spot welds and then inserted across the opening as a unit and then secured to the casing by spot welds. It can be seen that in operation the burner will produce substantially similar rows of flames from the corresponding gas passages.

The size and threading of the rods may be selected to produce the desired flame characteristics. In a commercial bakery oven, wherein the items to be baked are carried over an array of burners by series of conveyors, a variety of different burner configurations may be used within the oven so as to produce a desired thermal profile as the items pass through the oven.

The threaded rods are used as flow directing bodies located across the openings because of advantages in availability and cost. A number of other configurations would be possible. Any corrosion resistant body with a central core and a plurality of lateral projections cut from and disposed about the core, such as a ribbed rod will function similarly. There may also be employed a burner tube which has multiple elongated openings to receive multiple threaded rods.

The linear burners have been operated successfully, i.e., by providing uniform flames lines of lengths of 12 feet or more for protracted periods of time with high efficiency outputs of 1.5 million BTU or more without evidence of plugging or corrosion. The fuel-air feed may be forced draft as provided by externally premixing of fuel and air or natural draft as provided by injection of fuel into a venturi to aspirate air to enable uniform combustion along the length of the burner. While fuel air mixture is typically a methane-air mixture propane-air mixtures may also be used. As compared to prior art linear burners which are initially 60 to 70% efficient with efficiency dropping to 50% as corrosion sets in and which require replacement within 18 months the burners of the instant invention have been observed to maintain a high constant level of fuel consumption efficiency with no evidence of deterioration with time.

The foregoing description of this invention is not an exhaustive catalog of all the ways in which the invention can be practiced in structural or procedural contexts. Rather, the description is illustrative and exemplary. Workers skilled in the art to which the invention pertains will recognize and readily appreciate that other arrangements are possible within the fair scope of the invention and by which the advances made possible by the invention can be achieved. For example, the invention may be applied to a burner with a hollow casing other than a circular sectioned tube. A burner tube may be of any reasonable length and need not have a sealed end but may have both ends connected to gas sources or may have an end connected to another burner tube or manifolded in parallel. The burner opening need not be straight but might be curved such as to receive a rod with has been bent to the corresponding curve.

Accordingly, the following claims are to be read, where proper, as having application to both those things described above and shown in the drawings, and those other things which, while not expressly described, are within the fair scope of the invention according to the principles of equivalence.

What is claimed is:

1. A burner comprising:

a conduit, adapted to receive a combustible fuel-air gas mixture, said conduit having inner and outer surfaces and at least one elongate opening extending lengthwise between the ends of the conduit providing elongate side walls and end walls from the outer to the inner surface; and at least one corrosion resistant gas flow directing body located along and in the elongate opening and secured thereto, said gas flow directing body comprising a threaded rod forming a plurality of discharge passages between threads on said rod and at least one of said side walls.

2. The burner as claimed in claim 1 wherein a row of discharge passages is formed on both sides of said threaded rod between said threaded rod and said side walls.

3. The burner of claim 1 wherein the elongate side walls each have an inwardly curved profile.

4. The burner of claim 1 wherein the conduit comprises a tube of substantially circular cross section.

5. The burner of claim 3 wherein the conduit comprises a tube of substantially circular cross section.

6. The burner of claim 4 wherein the tube has a first threaded tube end and means for sealing the tube at an opposed second end.

7. The burner of claim 5 wherein the tube has a first threaded tube end and means for sealing the tube end at an opposed tube second end.

8. The burner of claim 1 wherein the threaded rod is stainless steel.

9. The burner as claimed in claim 8 including a second stainless steel rod arranged side-by-side and with said first rod secured to each other to create at least three rows of gas flow passages.

10. The burner of claim 9 further comprising baffle means disposed between the pair of threaded stainless steel rods for separating the first and second threaded rods to create a fourth row of gas flow passages.

11. A burner adapted to receive a combustible gaseous fuel-air mixture, comprising:

a metal tube of circular cross section, having first and second tube ends and an elongate channel opening in the tube said elongate opening having two opening ends and two opening sides, said opening sides being inwardly sloping;

threads formed about the first tube end for connection to a gaseous fuel-air source;

means sealing the second tube end;

a threaded stainless steel rod inserted in and extending along the elongated opening and contacting the two inwardly sloping opening sides; and a plurality of spot welds securing the threaded stainless steel rod to the metal tube at least at the opening sides in contact with the threads of the threaded stainless steel rod.

12. The burner of claim 11 wherein the threaded stainless steel rod is a 10–24 threaded stainless steel rod and the metal tube is American Standard Schedule 40 one-inch nominal diameter steel pipe.

13. A burner as claimed in claim 11 in which the inwardly sloping opening sides have a curved profile.

14. A burner as claimed in claim 12 in which the inwardly sloping opening sides have a curved profile.

15. A burner comprising:

a metal tube of circular cross section, having first and second tube ends and an elongate opening in the tube having two opening ends and two opening sides, said opening sides being inwardly sloping;

threads formed about the first tube end for connection to a gaseous fuel source;

means sealing the second tube end;

first and second threaded stainless steel rods disposed substantially along the elongated opening and each contacting one of the two inwardly sloping opening sides; and a plurality of spot welds for securing the first and second threaded steel rods to each other and to the opening sides.

16. The burner of claim 15 wherein the first and second threaded steel rods are 10–32 threaded stainless steel rods and the metal tube is a 1 3/16 inch external diameter steel tube.

17. The burner of claim 15 further comprising stainless steel baffle means disposed between the first and second threaded steel rods by separate first and second threaded steel rods to create first and second pluralities of gas flow passages between the rods and the baffle, said rods being secured to the baffle by spot welds.

18. The burner of claim 17 wherein the first and second threaded steel rods are 10–32 threaded stainless steel rods and the metal tube is a 1 3/16 inch external diameter steel tube.

19. A burner as claimed in claim 15 in which the inwardly sloping opening sides have a curved profile.

20. A burner as claimed in claim 16 in which the inwardly sloping opening sides have a curved profile.

21. A burner as claimed in claim 17 in which the inwardly sloping opening sides have a curved profile.

22. A burner as claimed in claim 18 in which the inwardly sloping opening sides have a curved profile.

* * * * *

UNITED STATES PATENT AND TRADEMARK OFFICE

CERTIFICATE OF CORRECTION

PATENT NO. : 5,322,224

DATED : June 21, 1994

INVENTOR(S) : Edward F. Ruiz

It is certified that error appears in the above-indentified patent and that said Letters Patent is hereby corrected as shown below:

Column 1, line 9, change "particularly" to
-- particular --.
Column 1, line 13, before "force" change "an"
to -- a --.
Column 3, line 28, after "frame 48" delete the comma.
Column 3, line 42, delete "of means" (second occurrence).
Column 3, line 64, delete "advantageous as if the rods were inserted individually, there"
and insert therefor
-- advantageous because if the rods were inserted individually there --.

Column 4, line 8, after "between" change "rod" to
-- rods --.
Column 4, line 15, before "preferably" delete "a".
Column 4, line 48, after "uniform" change "flames" to
-- flame --.
Column 4, line 56, after "mixture" (second occurrence) insert a comma.

UNITED STATES PATENT AND TRADEMARK OFFICE

CERTIFICATE OF CORRECTION

PATENT NO. : 5,322,224

DATED : June 21, 1994

INVENTOR(S) : Edward F. Ruiz

It is certified that error appears in the above-indentified patent and that said Letters Patent is hereby corrected as shown below:

Column 5, line 10, change "manifolded" to -- manifold --.

Column 5, line 12, change "with" to -- which --.

Signed and Sealed this

Thirteenth Day of December, 1994

*Attest:*

Bruce Lehman

BRUCE LEHMAN

*Attesting Officer*

*Commissioner of Patents and Trademarks*